US006375114B1

(12) United States Patent
Mayer et al.

(10) Patent No.: US 6,375,114 B1
(45) Date of Patent: Apr. 23, 2002

(54) PROCESS AND AN APPARATUS FOR THE SERVICING OF A TEXTILE MACHINE

(75) Inventors: Walter Mayer, Ingolstadt; Adalbert Stephan, Beilngries/Paulushofen, both of (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 09/606,263

(22) Filed: Jun. 29, 2000

(51) Int. Cl.[7] ..... B65H 67/04; B65H 54/71; B26D 7/08

(52) U.S. Cl. ..... 242/476.6; 83/168; 83/174; 242/473.8; 242/487.6

(58) Field of Search ..... 242/476.6, 476.4, 242/473.7, 473.8, 487.6, 487.7; 83/168, 169, 174, 913

(56) References Cited

U.S. PATENT DOCUMENTS

| | | | | |
|---|---|---|---|---|
| 1,812,942 A | * | 7/1931 | Gaines | 83/168 X |
| 4,069,983 A | * | 1/1978 | Muramatsu et al. | 242/473.7 |
| 4,108,388 A | * | 8/1978 | Schär | 242/473.8 |
| 4,552,314 A | * | 11/1985 | Noguchi et al. | 242/476.6 |
| 4,942,730 A | * | 7/1990 | Morrison | 242/487.6 X |
| 5,676,322 A | * | 10/1997 | Stahlecker | 242/473.7 |
| 5,738,290 A | * | 4/1998 | Straaten et al. | 242/473.7 |

FOREIGN PATENT DOCUMENTS

| | | |
|---|---|---|
| CH | 535711 | 5/1973 |
| DE | 4213859 A1 | 11/1992 |
| DE | 4312823 A1 | 10/1993 |
| DE | 4438501 A1 | 5/1996 |
| DE | 19644593 A1 | 4/1998 |
| EP | 0394885 A1 | 10/1990 |
| EP | 0417849 A1 | 3/1991 |
| GB | 1470450 | 4/1977 |

OTHER PUBLICATIONS

German Patent Office Search Report, Nov. 12, 1999.
Abstract of Japan (3–143874) Sep. 12, 1991 vol. 15/No. 362.

* cited by examiner

*Primary Examiner*—Michael R. Mansen
(74) *Attorney, Agent, or Firm*—Dority & Manning, P.A.

(57) ABSTRACT

During the service of a workstation of a textile machine, a thread, presented to a spool apparatus, is captured by a capture mechanism coordinated with the spool apparatus and conducted to a thread cutting device to be cut through. The thread cutting device is coordinated with a cleaning apparatus, with the help of which the thread cutting device at specified intervals, and/or in dependency of the carrying out of assigned work phases is subjected to cleaning.

25 Claims, 4 Drawing Sheets

PROCESS AND AN APPARATUS FOR THE SERVICING OF A TEXTILE MACHINE

BACKGROUND

The present invention concerns a process and apparatus for service at a workstation of a textile machine in which a thread is presented to a spool apparatus. The thread is captured by the spool apparatus and conducted to a thread cutting device to be cut through. The thread cutting device at specified intervals of time and/or in dependency of the execution of specified work phases is subjected to a cleaning operation.

In the case of textile machines with a spool apparatus, a full spool upon reaching a specified winding thickness is ejected from the spool apparatus and in its place an empty spool is inserted into the spool apparatus. Where open-end spinning machines are concerned, at this point a thread which has been previously winding and is now being carried in a suction stream is given over to the already driven spool apparatus, whereby it is necessary to break off the connection between thread winding on the new empty spool and the thread section which is moving in the suction line. For this operation, the spool apparatus possesses a thread cutting device which feeds the threads captured by a capture apparatus to the spool apparatus for the severing, whereupon the surplus thread section can be removed by the suction (DE 196 44 593 A1). Experience has demonstrated that the degree of efficiency of the thread cutting device deteriorates with time. On this account eventually upsets can occur wherein especially when instigated by the non-cutting of the thread, a section of thread remains which can be carried from the workstation to a mobile maintenance carriage which is serving in front of the concerned workstation. The said thread section can now extend itself over the area of several neighboring work places until the thread section either is pulled out of the suction, or as a result of its increasing tension the thread breaks at a random workstation. The thread end released in this manner can find its way into the rotating parts of the spool apparatus or into other elements of the textile machine which leads to the difficulty that the removal of the filled spool at a later time is made difficult.

SUMMARY OF THE INVENTION

Thus, it is the purpose of the invention to create a process and an apparatus with the aid of which the mentioned disadvantages are avoided and, for longer periods, a reliable cutting of the thread is achieved. Additional objects and advantages of the invention will be set forth in part in the following description, or may be learned through practice of the invention.

In accord with the invention, the stated purpose of the invention is achieved by the features of a process and apparatus for service at a workstation of a textile machine in which a thread is presented to a spool apparatus. The thread is captured by the spool apparatus and conducted to a thread cutting device to be cut through. The thread cutting device at specified intervals of time and/or in dependency of the execution of specified work phases is subjected to a cleaning operation. By means of the cleaning of the thread cutting arrangement, which is carried out from time to time, the consolidated depositions such as coatings and fiber remnants which have collected since a prior cleaning are again so quickly removed from the thread cutting device that heavy contaminations cannot occur to the extent that the thread cutting operation is impaired.

If the cleaning is carried out to include other specified phases of operation, then it is of advantage if in an inventive manner the cleaning of the thread cutting device is carried out before or after a thread transfer on the spool apparatus, and/or before or after the carrying out of a thread-connection procedure. Such cleaning as takes place at these other phase operations is so timed, that no interference which could lead to manufacturing disturbances occurs between said cleaning and the service operations.

A particularly intensive cleaning can be achieved by a method of procedure in accord with a process where the cleaning in relation to the thread cutting device is done in an oppositely set direction to the thread transport direction and/or, a process where the cleaning is executed in an intermittent manner.

Besides the thread cutting operation, the area of the spool apparatus proximal to the thread cutting device is, to a considerable degree, subject to dirt deposition. In order to create aid at this point, simultaneously with the cleaning of the thread cutting device additional elements of the spool apparatus are subjected to a cleaning. Also the elements of the spool apparatus in the hereto related neighborhood undergo a cleaning. By means of measures in accord with a process where the driveable elements of the spool apparatus to be cleaned are actively driven during their cleaning, the cleansing action in this particular cleaning relative to the additional elements of the spool apparatus can be improved.

The cleaning can be undertaken with the aid of various means among which are mechanical procedures. Respectively, in accord with the choice of cleaning elements or the means of cleaning in accord with the invention a further development of the invented process can be provided wherein the sharpening of the thread cutting device becomes integrated with the cleaning thereof.

For the execution of the described process, the features of an apparatus for the servicing of a workplace on a textile machine are provided. This includes a spool apparatus for the winding of a thread. From an operational position in which an empty spool or a spool inserted in the spool apparatus can be driven by a stationary drive roll, it can be brought into a thread transfer position. The spool apparatus possesses a driveable capture mechanism and a stationary thread cutting device opposite to the driveable thread capture mechanism. The thread to be cut is presentable by the rotation of the capture mechanism. A cleaning apparatus is assigned to the thread cutting device, and the coordination of the cleaning apparatus can be undertaken in various ways. Thus, it is not a requirement that the cleaning equipment be found immediately in the neighborhood of the thread cutting device. The invention also provides an apparatus where the cleaning apparatus by means of a relative movement between it and the thread cutting device can be brought into an operational position coactive with the thread cutting device. Relative motion between the two allows the cleaning operation to clean the thread cutting device. In doing this it is immaterial, principally, whether or not the thread cutting device is moved to the cleaning apparatus or vice versa.

In accord with a further design of the apparatus, the cleaning apparatus is located on a presentation apparatus which is placed on a mobile service carriage patrolling along a multiplicity of workstations of the textile machine. The cleaning apparatus is moveable out of an at-rest position into the operational position and back. By means of the movement of said presentation apparatus, the cleaning apparatus can be brought out of an at-rest position which is distant from the thread cutting device into an operational position close to the thread cutting device. This presentation apparatus can, essentially, be placed respectively at each spool position. However, based on savings in material and costs it is of advantage if this presentation apparatus is installed on a patrolling service carriage. In this case, it becomes advantageous if the presentation apparatus, now mounted on the service carriage, is furnished with an auxiliary drive for the spool or for the empty spool casing.

For the achievement of an optimal degree of efficiency in regard to production and maintenance, in accord with a further improvement of the object of the invention, the cleaning apparatus communicates with a controller. Also, with the aid of the controller it can be activated except during the time period during which the thread is presented to the capture mechanism and/or the equipment for the connection of a thread is active. Hence, the service equipment and the operation of the cleaning apparatus are timed to chronologically coact to avoid mutual interference.

Contamination deposits form because of the relative movements of the thread in respect to the thread cutting device. Selectively, according to the kind of materials which, for instance, either adhere to or remain on the thread cutting device, the depositions can be effectively removed from said thread cutting device if as demonstrated in another embodiment, the direction of action of the cleaning apparatus is opposite to that direction in which the threads to be cut are being led to the thread cutting device.

The cleaning apparatus can be designed to operate by various means, for instance by a hydraulic system. In accord with a preferred embodiment, the cleaning apparatus operates on a pneumatic cleaning basis and possesses a compressed air nozzle.

The degree of efficiency of the thread cutting device can deteriorate over prolonged time, respectively in accord with its design or with rapidity of dulling. On this account, an apparatus is provided in that the cleaning apparatus or the cleaning medium leaving the cleaning apparatus is designed as a sharpening means for the thread cutting device.

In order to apply the cleaning apparatus precisely to the thread cutting device, the cleaning apparatus is provided with a flexible or flexibly secured guide coacting with the spool apparatus, and can possess a guide. This guide is designed to direct the cleansing agent which may be a jet of compressed air or pressurized fluid or to direct one of the nozzles for the cleansing agent. If this is done, then in different ways and dependent upon the relative positioning between the cleaning apparatus and/or the guide on the one hand and the spool apparatus on the other, it is even possible that the cleansing material or the cleaning element can be guided and/or directed to carry out the cleaning of additional elements of the spool apparatus.

As a rule, the deposits loosened from the thread cutting device are not particularly large as far as quantity goes so that a separate reclaim or disposal system would be superfluous. Nevertheless, it can be of advantage if the cleaning apparatus possesses a dirt catcher. A retention provision is made for the contamination loosened from the thread cutting device. This can be done in accord with an apparatus therein characterized, in that the cleaning apparatus possesses a suction air nozzle. It is possible that the cleaning apparatus can integrate this feature into itself.

Not only the thread cutting device, but also the ambient surroundings are endangered by contamination since because of the scraping-like thread cutting with the help of the thread cutting device, components are set free which are air borne in the neighborhood of the thread cutting device and settle in that locale.

In an additional advantageous embodiment of the apparatus in accord with the invention, the cleaning apparatus can serve, besides the thread cutting device, also additional parts of the spool apparatus. The capture mechanism on the side proximal to the thread cutting device especially can be served. Additionally, the elements of the spool apparatus to be cleaned by the cleaning apparatus, especially the capture mechanism, can be driven during their cleaning. These elements can be made actively or passively available by an appropriate relative movement. In this embodiment, a possible drive for the driven elements of the spool apparatus produces a relative movement in relation to the cleaning apparatus, which improves the results of the cleaning, which is reflected in the cleanliness of the elements found in the neighborhood of the thread cutting device.

The object of the invention is simple in its construction and thus economical, and further can be refitted without difficulty onto already existing textile machines. The apparatus in accord with the invention as an added advantage requires little space. Experience has shown that thanks to the invented process and apparatus, a positive severing of the thread is achieved in an efficient and long lasting manner. No wild, uncontrolled thread filaments arise which as a result of a poorly operating cutting process, migrate to a service carriage which is just leaving the serviced workstation or to driven elements of the carriage, or yet extend themselves to a neighboring workstation, all of which leads to production disturbances.

BRIEF DESCRIPTION OF THE DRAWINGS

In the following, embodiments of the invention will be described in greater detail with the help of the drawings. There is shown in.

DETAILED DESCRIPTION

Figure 1:
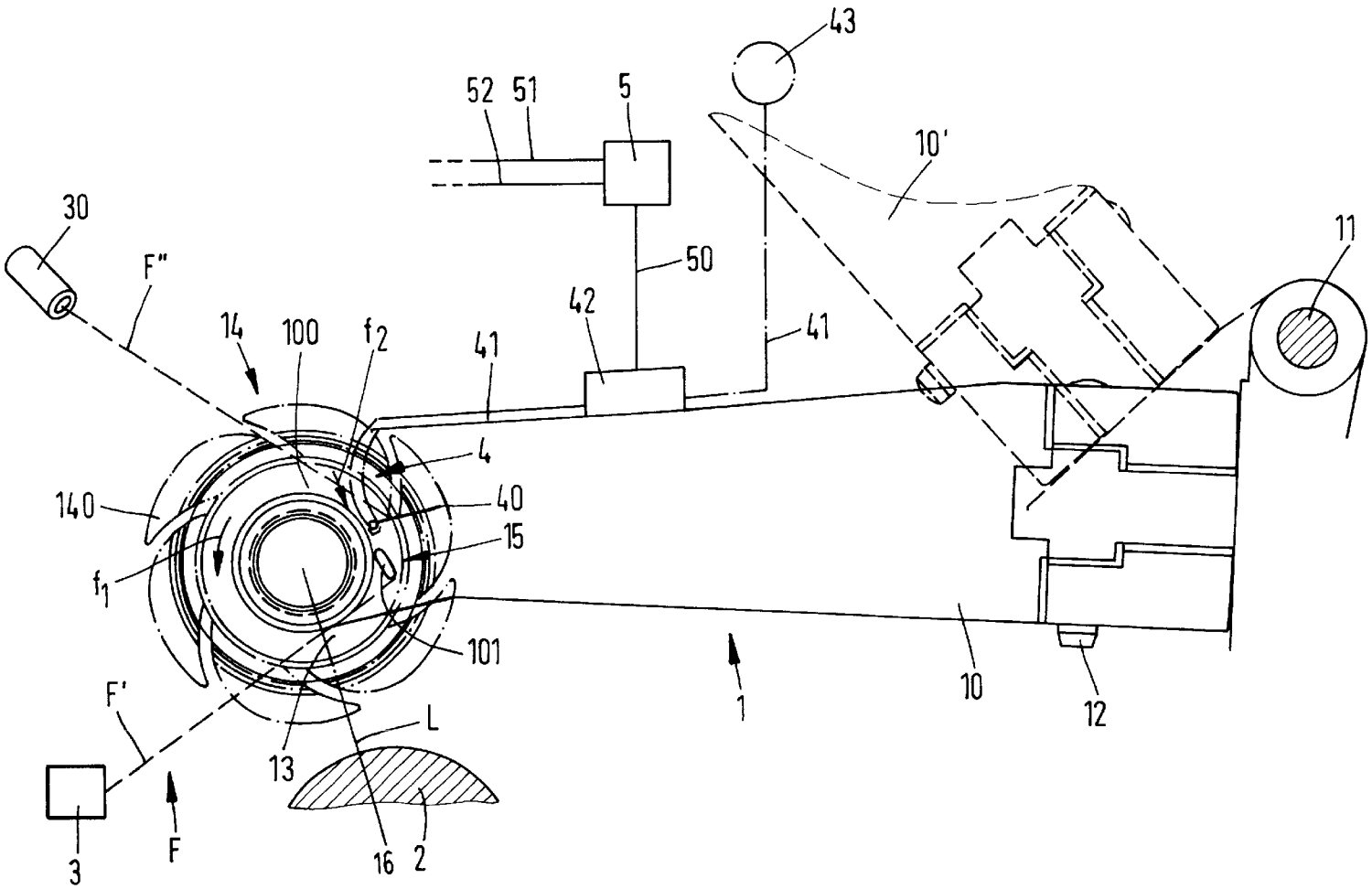
FIG. 1: A profile view of a spool apparatus with a thread cutting device and a cleaning device provided on the spool apparatus in accord with the invention.

Reference will now be made in detail to one or more embodiments of the invention, examples of which are shown in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations as come within the scope and spirit of the invention.

Textile machines of the most different types, ie. ring, open-end, or windup spinning machines, and spinning machines or the like exhibit a multiplicity of workstations, each with a respective spool apparatus 1 (FIG. 1). All have the purpose of accepting a continuously guided thread F onto an empty spool 16 and forming a (not shown) filled spool by winding said thread thereon.

FIG. 1 shows the essential elements of the spool apparatus 1 of a textile machine of the above type. FIG. 1 shows besides the spool apparatus 1 a part of a spool roll, this being the member which drives the spool apparatus during normal operation.

The spool apparatus 1 has two spool arms 10, of which only one is visible in the drawing. These are mounted in bearings to pivot on an axle 11 of the textile machine so that the spool arms 10 can be swung over against the spool roll 2 (see dotted line position 10' of the spool arm 10). At least one of the two spool arms 10 possess a linkage 12, which allows prying apart, to a certain extent the spool arm 10 (or arms 10). This is done to permit the two spool arms 10 to accept at their free ends 100 an empty spool 16 and, when the arms are released, to clamp same in place between them. For this purpose each of the two spool arms 10 respectively possesses on its free end 100 one rotatable spool plate 13. Of these two spool plates 13, one plate is equipped with a capture mechanism 14, held by one of the two spool arms 10.

On the spool arm 10, which carries the spool plate 13 with the capture mechanism 14, a thread cutting device 15 is placed. This can be constructed in a conventional manner to show different cutting elements, some operating thermally that is with an incandescent filament, or operate otherwise such as mechanically.

Figure 4:
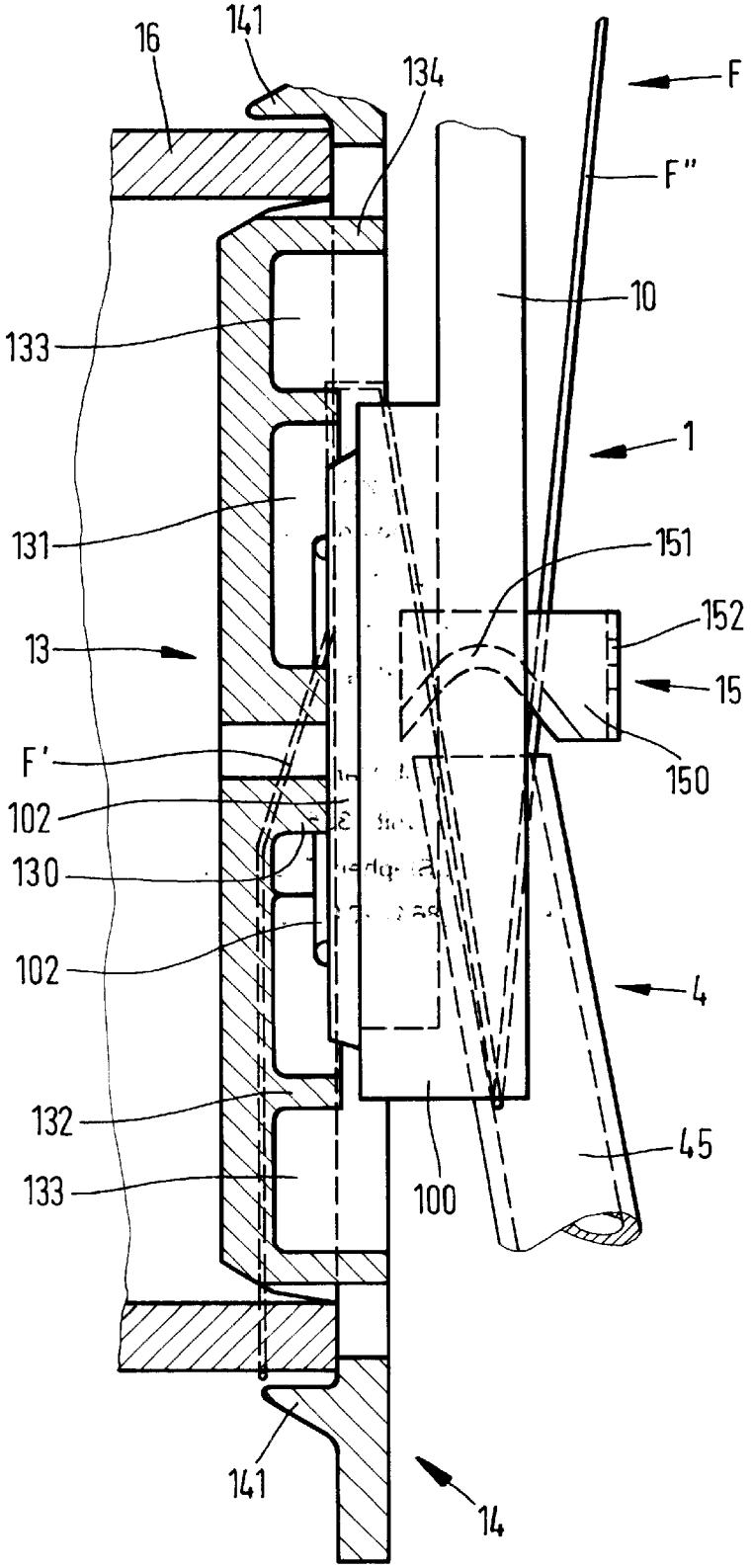

Mostly, in practice a mechanically operating thread cutter 15 is installed, as this has been described in the foregoing description and which is particularly well presented in FIG. 4. In accord with this embodiment the thread cutter 15 possesses a blade 150 with a thread cutting edge 151.

The blade 150 extends itself through an opening 101 in the spool arm 10 (see FIG. 5) and exhibits outside of the operational area of the thread cutting blade 151 a fastening section 152 which is angled perpendicularly to the spool arm 10. With the help of section 152, the blade 150 by means of an interposed (not shown) spacer is fastened to the spool arm 10.

The capture mechanism 14 principally can be of an optional type. In accord with the embodiment depicted in FIGS. 1, 2, 4, and 5, the capture mechanism 14 is constructed in the form of a plurality of capture hooks 140 which are an integrated component of the spool plate 13. If the capture mechanism 14 with the help of the mentioned empty spool 16 or of a spool already inserted in the spool apparatus 1 is driven then the capture mechanism 14 rotates in the direction of the arrow $f_1$.

The thread cutting edge 151 of the cutter or the blade 150 of the thread cutting device 15 confronts the thread F, which is supplied to it by the rotation of the capture mechanism 14 in the direction of the arrow $f_1$. (See FIG. 1.)

During normal operation during which the empty spool 16 is rotated by contact against the spool roll 2, the thread F is being wound up. In FIG. 1, however, the spool apparatus 1 assumes its elevated position so that an empty spool 16 introduced therein will not be driven by said spool roll 2.

In the case of an open-end spinning machine which has been chosen as an example for this description, and following the insertion of an empty spool 16 between the spool plates 13 of the two spool arms 10 of the spool apparatus 1, a thread F extending itself from a simply indicated delivery point 3 to a suction source 30 to the capture mechanism 14 in a conventional manner is so placed that the thread F crosses the rotation track of the capture mechanism 14. This capture mechanism 14 immediately seizes during its rotation the thread F with the help of a capture hook 140.

The following concerns the thread F' which is a sectio n of the thread F which latter as described above has been seized by the capture hook 140 of the capture mechanism 14.

Upon the rotation of the empty spool 13, thread section F' which is a section of the thread F which was seized by the capture hook of the capture mechanism 14, finds itself on the side proximal to the delivery point 3 in relation to the capture hooks 14 which are now carrying the thread F. The thread section F' is now clamped in between segments 141 which are carried by the spool plate 13, overhanging the empty spool 16 and the circumferential surface of the empty spool 16 and by this means is secured in position. The thread section F' which is continually supplied by source point 3 runs on now for the formation of a reserve winding because of the so-called wind-up tension with its feed side over a specified axial stretch along the empty spool 16 in the direction of its central area.

The thread section F" which stretches from the capture hook 140 to the suction source 30 during the rotation of the capture mechanism 14 moves to the underside (in reference to FIG. 4) of the free end 100 of the spool arm 10. By further rotation of the capture hook 140, which is taking along the thread F, the thread section F" is continually more and more wound around. When the capture hook 140 which is carrying the thread F after this has passed by the imaginary line L (FIG. 1) between the empty spool 16 and the spool roll 2, thread section F" is always more distanced from the feed side of the thread F. By means of this entwining of a part of the spool arm 10, the restraining friction in the thread F which by this means is blocked in the cutting area, when this comes into the zone of the thread cutting edge 151 of the thread cutting device 15.

Figure 2:
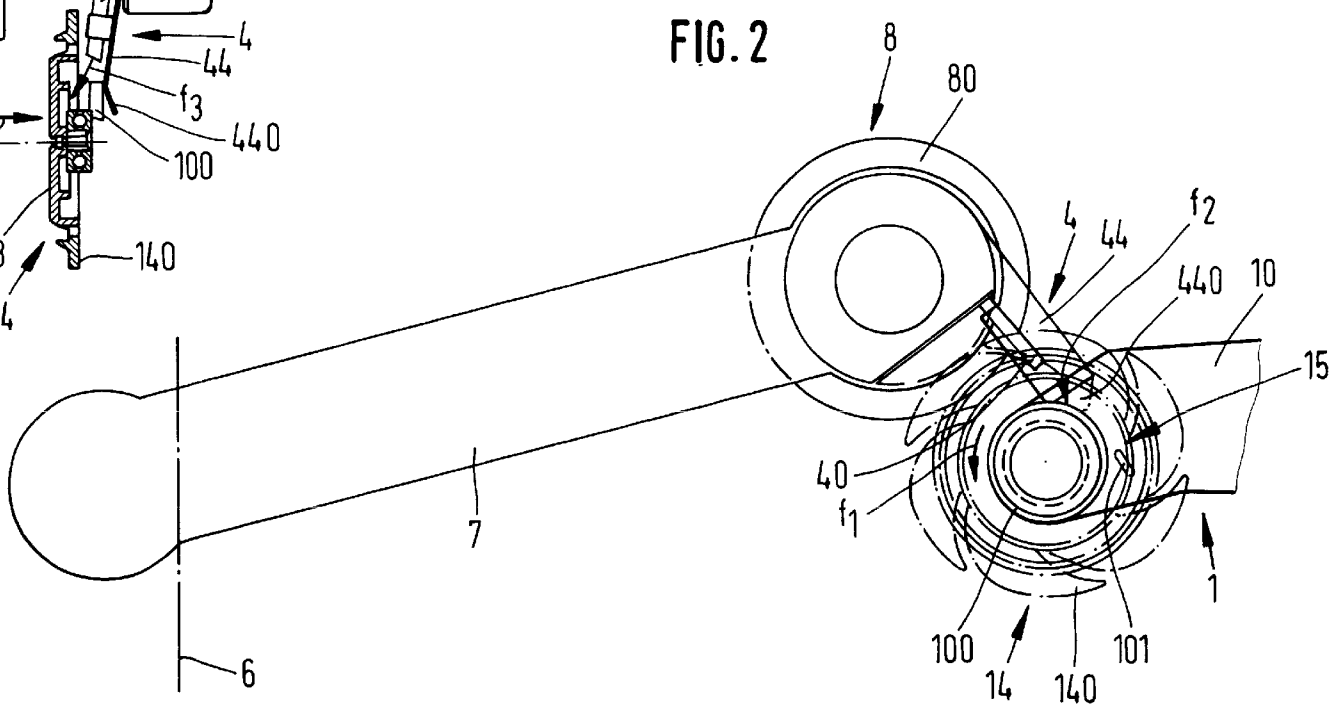
FIGS. 2 and 3: Respectively, a front and side view of a presentation apparatus mounted on a patrolling maintenance apparatus for one of the auxiliary drive rolls of the spool apparatus as well as for the pneumatic cleaning apparatus in accord with the invention, FIG. 4 A front view, partially sectioned, of a cleaning apparatus operating with suction, FIG. 5 A profile view showing a mechanical cleaning apparatus with a dirt capturing shell as well as a dirt removal transport system operating by suction.
Figure 5:
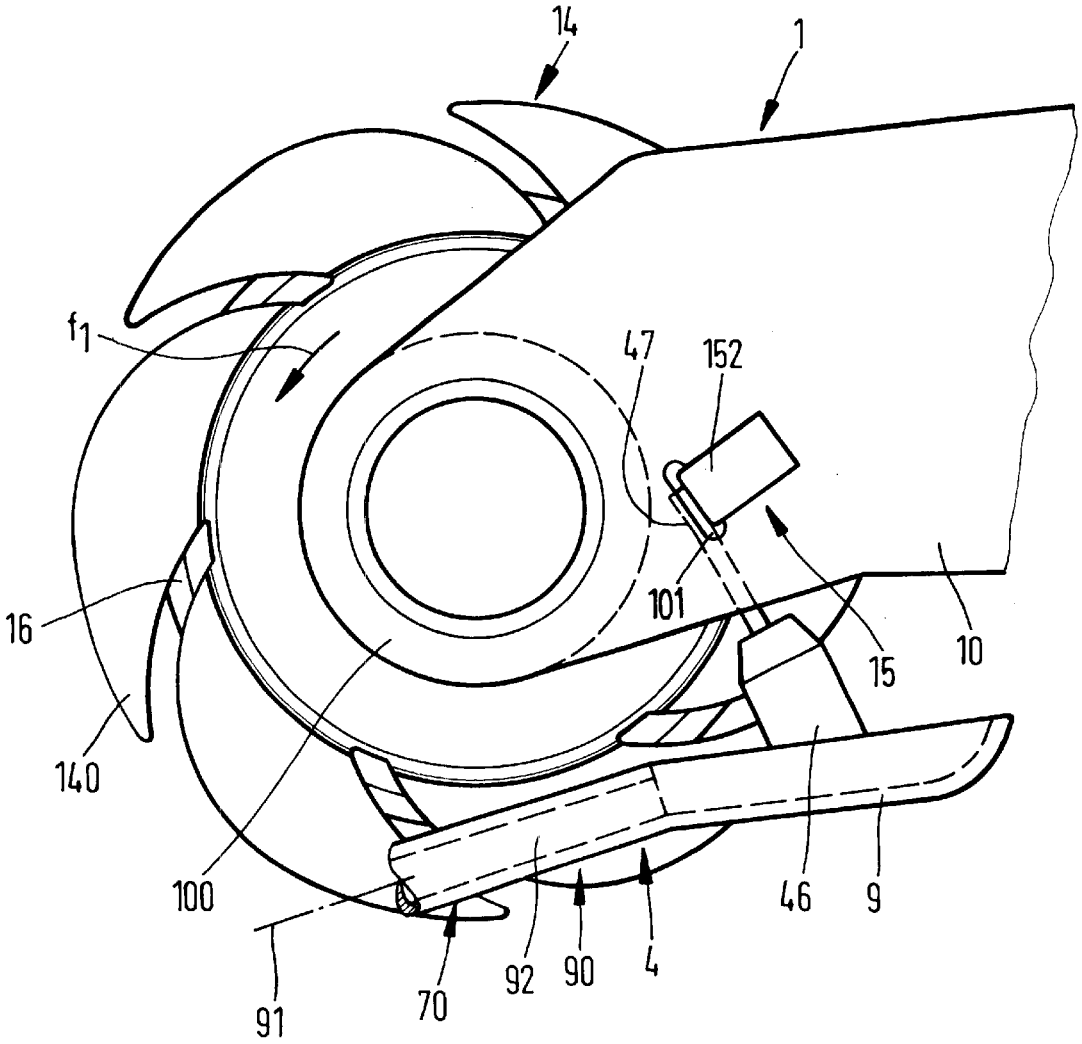

As is shown in FIGS. 1, 2 and 5, this thread cutting edge 151 in relation to the run of thread is not really at right angles thereto, but so inclined that the thread F during the rotation of the capture hook 140 is drawn along the thread cutting edge 151. This leads as a rule to a very quick cutting through of the thread F, the free cutoff end of which (thread section F") is now carried away through the suction system 30.

Since the feed side of the thread F (thread section F') was previously secured between segment 141 of the spool plate 13 and the empty spool 16 by means of clamping, the thread F even after this cutting procedure remains safely held on the empty spool 16.

Thread F forms in a known fashion in the end area of the empty spool 16, parallel reserve windings which in the procedure of subsequent work are required for the binding of the threads of two spools. In coinciding timing with the capture of the thread F, the empty spool 16 by the dropping down of the spool arm 10, is brought onto driving contact with the spool roll 2. If a sufficient number of reserve windings have been laid down, then the thread section F' which was previously held back in the required position for the formation of reserve windings relative to the longitudinal extent of the empty spool 16 is now released in a known manner, so that it on the basis of the existing tendency of the winding tension, takes the shortest way between the delivery point 3 and the empty spool and the thread F migrates in the direction of the empty spool middle whereby it is picked up by a self-threading back and forth driven traversing thread guide (not shown) and from this point on, is applied to the build up of regular traversely wound windings building up on the spool.

During the scraping and rubbing movement of the thread F, there sets up on the thread cutting edge 151 during the cutting procedure a very hard deposit of the components contained in the thread F including micro particulate especially as a result of coatings and the like.

These adherent components depositing themselves on the thread cutting device 15 lead after a time to spreading and thus to a dulling of the thread cutting edge 151 of the blade 150 or cutter of the thread cutting device 15. Such contamination can gradually reduce the degree of efficiency of the thread cutting edge 151 so far that the functionality can no more be relied on. The thread section which extends from the delivery point 3 to the capture mechanism 14 is indeed wound on the newly inserted empty spool 16 so that in this case a spool is formed, although a thread section F" which erroneously is not cut through, then extends itself between the capture mechanism 14 to the suction source 30 and as a result of the rotation of the rotating capture mechanism 14 will wind itself up in an uncontrolled manner at the end 100 of the spool arm 10 and at the same time is removed by the suction device 30.

The re-introduced thread F built out of the uncontrollable thread section F" which is wrapped about elements in the area of the capture mechanism 14 forms under these circumstances a jumbled snarl which leads to disturbance of the winding procedure. Moreover, the end of the thread section F" pulled from the suction system 30 will break due to the continual increasing tension. Further, then when the end of this thread section F" leaves the suction system 30, quickly as a result of the abrupt drop in tension at the textile machine, the formation of a jumbled snarl is favored and probably extends itself even into the area outside of the spool apparatus 1, for instance, even into the area of a neighboring workstation. Even at a workstation just serviced or as well at a neighboring workstation, this thread section F" can find its way into the area of the forward placed feed-in rolls of the spool apparatus 1 (not shown) and there lead to disturbances and damage.

In order to avoid the risks outlined above, a cleaning apparatus 4 is located in accord with FIG. 1 on the spool arm 10. This apparatus is installed in the same manner as the depicted embodiment and designed to operate pneumatically. The cleaning apparatus 4 possesses a compressed air nozzle 40 which by means of an air line 41 and an intermediate control valve 42 stands in communication with a schematically indicated compressed air source 43. The control valve 42 is also in communication with control device 5 by means of a control line 50, with other (not shown) systems (through control lines 51 & 52) and apparatuses of the same workstation as well as a central control apparatus (not shown) (through control lines 51 & 52).

The depicted compressed air nozzle 40 is so arranged and oriented that a jet of compressed air is emitted by the air nozzle 40. This jet ejects in the direction of the arrow $f_2$ against the cutter or the blade 150. As this takes place, then the cleaning action direction (see arrow $f_2$) is essentially directed opposite to the feed direction of the thread F toward the thread cutting mechanism 15 which is designated as above by the arrow $f_1$. In this way the contamination components which are adhering to the side surfaces of the blade 150 are removed. At the same time, fiber particles which have deposited themselves during the cutting procedure and are left hanging on the blade 150 are peeled off by the compressed air stream oriented as described above.

The control apparatus 5 has the purpose at specified times of bringing the thread cutting apparatus 15 into action for a set time span by the activation of the control valve 42 and then at end of set time to shut off said control valve 42. In this operation, the provision can be made that the compressed air supply during the activated period does not operate permanently at the same intensity. The compressed air jet can be pulsated to attain an increase in the degree of efficiency of the blade 150 of the thread cutting device 15. In this controlled pressure variation, the pressure is dropped from a specified maximum level to a minimum value which is set to be other than zero and then returned therefrom to the maximum level.

The cleaning procedures can be carried out at any optimal time particularly by the installation of an integral cleaning apparatus 4 at each work station, for instance, by placement as shown in FIG. 1 on one of the two spool arms 10 of a work station.

It is also possible to carry out these cleaning operations under the regulation of controller 5 at specified time intervals wherein one of these kinds of cleaning devices 4 is provided at each spool apparatus 1. As alternate, the same can be installed on a patrolling service carriage 6 as in FIG. 2 which would observe the same specified time intervals. FIG. 2, however, shows a differently designed cleaning apparatus 4, which will be described later, to deliver the cleaning impulse to the individual spool apparatus 1 to be serviced. If the matter is assigned to a service carriage 6, which also has other service operations to furnish, for instance a spool exchange or a connection procedure such as the tying or splicing torn threads in the spool machines or to carry out a start-up procedure in an open-end spinning machine, then these activities do not permit a service carriage 6 to operate all these functions including cleaning in a chronologically exact series of intervals, while on the other hand the required spool changes and connection procedures must be attended to immediately as called for.

For the above reasons, it becomes necessary to couple the cleaning of the thread cutting device with a service directly at the workstation, i.e. this being dependent upon such service phases as above.

This is also sensible in that the service in a workstation is only undertaken when a cutting procedure occurs. The risk that during the time between which two cutting procedures take place contamination settles on the thread cutting edge 151 is very small in comparison to that of the cutting procedure, during which the particulate is released from the thread F.

In case of a pneumatic or another but non-mechanical cleaning (for instance, by ultrasonics), it can be reasonable to undertake the cleaning procedure during the transfer of the thread F into the spool apparatus 1. In order to exclude any disadvantage by this method for cleaning procedure, it is recommended to carry out the cleaning of the cutting device 15 either before or after the transfer of the thread into the spool apparatus.

The services to be performed on a spool apparatus 1 are in accord with each kind of textile machine, each of a different nature. Thus for instance in the case of a spool machine after a thread-break (voluntary or involuntary, for instance for the excision of thick or thin stretches in the thread to be wound) during cleaning, knots or splices are produced. Differently, with open-end spinning machines after a thread-break the thread F must be reintroduced anew. In both cases however, within the confines of this description and these service procedures, the matter deals with thread connection with which the cleaning of the thread cutting device 15 is coupled in a time related way. This situation is independent as to whether or not service equipment for this task is installed separately at each work station, or upon need a mobile service carriage 6 is available.

When a service is carried out at each workstation, it is to be recommended that the cleaning of the thread cutting device 15 be executed with regard to other workstation services to the fullest possible extent and in such a manner that the cleaning procedure, for instance, occurs either before or after the thread connection procedure so that this is not disturbed by the cleaning of the thread cutting device 15.

The timing agreement of the cleaning with other service operations is done with the aid of the already mentioned, correspondingly programmed controller 5 in such a manner that the cleaning apparatus 4 performs its services with respect to the other services to be executed at that same workstation. However, this is done exclusive of any phase wherein the thread F is being manipulated in proximity to or in the area of the thread cutting device 15. This is necessary because first the manipulation presents the thread F to the capture mechanism 14 or, second an apparatus for the execution of a thread connection procedure is activated. A cleaning of the thread cutting device 15 can, however, be carried out simultaneously with operational phases for instance in regard to a change of batch. It is not required that the cleaning apparatus 4 be mounted on the spool arm 10 itself. As is evident from the indicated position 10' of the spool arm 10 in FIG. 1, the spool arm 10 can assume various pivoted positions. The spool arm 10 takes its raised position when the spool previously inserted an empty spool 16 builds up to reach its specified full state, and for the ejection of this full spool the spool arm is lifted free of the driving spool roll 2. For instance, provision can be made (not shown) that the cleaning apparatus 4 is placed stationarily on the textile machine in such a position that upon the lifting of the spool from the spool roll 2, the blade 150 of the thread cutting device 15 moves to an appropriate position for the cleaning thereof in which position the cleaning apparatus 4 has been located. The cleaning in this case can be introduced in connection with the reaching of this position and be operated for a given period, for instance, with the aid of a timing device provided in the controller 5.

The present description shows that it is not a requirement that the cleaning apparatus 4 is continually in one place of use. The cleaning apparatus can actively or passively take such a position that a relative motion occurs between it and the thread cutting device 15. In such an arrangement, it is totally of no consequence whether the cleaning apparatus 4 or the thread cutting device 15 or yet both are put into movement in order to bring the cleaning apparatus 4 out of its idle setting, that is, a first relative position in which it cannot clean the thread cutting device 15 into an operational position, that is a second relative position in which it is presented to the thread cutting device 15. cutting device 15 into an operational position, that is a second relative position in which it is presented to the thread cutting device 15.

In accord with another alternative embodiment (not shown) of a textile machine, such a cleaning apparatus 4 for the thread cutting device can be installed which is so uniquely placed in its service position probably also on the spool arm 10, and can be brought out of its idle position in which position the cleaning apparatus 4 is distanced from the to-be-cleaned thread cutting device 15 into an operational position. In this operational position the cleaning apparatus 4 is presented to the thread cutting device 15 and can thus clean the same. The movements necessary for this operation as well as the release and later interruption of the compressed air flow are controlled in an appropriate manner through the correspondingly programmed controller 5.

The cleaning apparatus and the here presented cleaning procedure can be altered in many ways and still remain within the framework of the present invention. This is possible since, for instance, individual features can be substituted for by equivalents or combined with such and moreover other combinations of the present features or equivalents may be made. So it is not necessary that the cleaning apparatus 4 for the proposed thread cutting device 15 on the spool apparatus 1 be placed on the textile machine like the cutting device 15. Much more likely it is entirely possible to install the cleaning apparatus 4 on a presentation device 7 (see FIG. 2) which in turn is placed on a mobile service carriage 6 which patrols along a plurality of workstations and with their aid the cleaning apparatus 4 is presented to said cutting device 15 for the carrying out of the cleaning of the same.

The contaminant components which with the aid of the cleaning apparatus 4 are removed from the thread cutting device 15, do not only adhere upon settling to the blade 150 of the thread cutting device 15, but they run to especially inconvenient locations as has been described above. By means of the scraping-like cutting through of the thread F, airborne particulate is formed which accumulates in the neighborhood of the thread cutting device 15. Besides the air borne particulate, there are other contaminating materials released from the thread which agglomerate in the neighborhood of the thread cutting device 15.

On this account, provision should be made that the cleaning apparatus 4 is so placed and oriented in its operational position that the compressed air jet is not only directed to blade 150 of the thread cutting device 15, but moreover can also be turned to the surrounding area thereof so that further elements of the spool apparatus 1 are included.

As may be inferred from FIGS. 4 and 5, the empty spool plate 13 has a complex form. This is particularly evident on the side proximal to the spool arm 10 and therewith also proximal to the thread cutting device 15. The spool plate 13 with the aid of a hub 130 and a bearing 102 (FIG. 4) is set into the spool arm 10 whereby the hub 130 is bordered radially inward by a ringlike recess 131 into which the bearing 102 partially enters. The bearing 102 is carried by the spool arm 10 and receives the hub 130. This ring shaped recess 131 on its own is bordered outward and radially by an annular web 132. This web 132 is on its outer side bordered by a further ring-like recess 133 which again is circumferentially encompassed from the outside by a further annular web 134.

Figure 3:
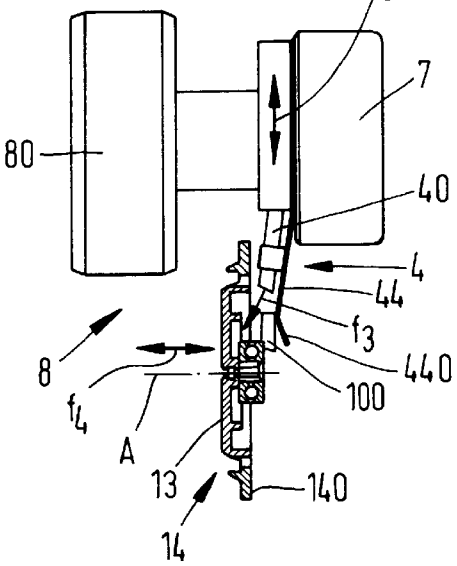

The two annular recesses 131 and 133 are particularly subject to the accumulation of contaminate materials on which account it is advantageous to bring these regions of the spool plate 13 into the area of the pneumatic cleaning. This can be done as is shown in FIG. 3 in that the jet of compressed air leaving the nozzle 40 of the cleaning apparatus 4 (see arrow $f_3$ in FIG. 3) not only is directed against the thread cutting device 15, but also emits a directional component toward the capture mechanism 14.

So that the capture mechanism 14 is subjected to the same intensity of cleaning about its entire circumference, it is advantageous if the spool plate 13 with the capture mechanism 14 by means of lowering the spool arm 10 onto the spool roll 2 by means of a previously inserted empty spool 16 or by means of a spool already winding is actively driven. As alternate, provision can be made that the capture mechanism is driven not by the spool roll 2, but by a drive roll 8. In this respect, see FIGS. 2 and 3 which will be discussed in detail later.

It is necessary both to thoroughly clean the thread cutting device 15 as well as to effectively include the neighborhood of said cutter in the cleaning procedure of this thread cutting device 15. A particular target is the capture mechanism 14. As shown in FIG. 3, the compressed air nozzle 40 is fastened on a guide 44 which takes care that the compressed air cannot miss locations to be cleaned. The guide further assures that the compressed air is concentratedly directed against the selected places to be cleaned.

The guide 44 for this purpose can be flexible which is achieved either through a flexible anchorage (not shown) or by a design wherein said guide 44 itself is flexible. In the case of a flexible anchorage for the guide 44, provision can be made that the compressed air nozzle 40 is movable parallel to the axis of rotation A of the capture mechanism 14 in one of the two directions of the double arrow $f_4$. This assures that the blade 150 of the thread cutting device 15 is cleaned, again referring to FIG. 3, both in its left and right end locations.

Again, provision can be made that by means of a movement in one of the directions transverse to the axis of rotation A of the capture mechanism 14 (see double arrow$_{F5}$) and by means of a corresponding guide 44 by a (not shown) guide angularity, the guide 44 is so far laterally displaced from its direction along the double arrow $f_5$ to a certain degree in one of the two directions of the double arrow $f_4$ that the compressed air nozzle 40 in accord with the position of the guide 44, the thread cutting device 15, the capture mechanism 14, or in an intermediate position of these two apparatuses 14, 15 is simultaneously located for service.

The desired movement of the guide 44 in one of the directions of the double arrow $f_4$ can also be achieved in that the guide is flexibly bound with the presentation device 7.

Similarly, the guide 44 is itself of flexible design and on its end possesses a displaced angularity 440 with which upon movement by the presentation device 7, the guide 44 abuts against the free end 100 of the spool arm 10 which is then so directed that the compressed air jet leaving the nozzle 40 exhibits the desired orientation.

The compressed air nozzle 40 in this procedure similarly to the guide 44 can be either flexibly bound to the compressed air line 41 or this compressed air line is made flexible itself at least in the area of and proximal to the compressed air nozzle so that the compressed air nozzle 40 can follow the prescribed direction changes called for by the guide 44.

In a design of the compressed air nozzle 40, conforming to the above when this said nozzle itself is flexible or is connected to the compressed air line by a flexible fitting (not shown), under certain circumstances a separate guide 44 can be dispensed with. In this case, the purpose of the guide 44 will be taken over by the compressed air nozzle itself in that this nozzle upon its installation on the free end 100 of the spool arm 10 is displaced in the desired manner from its former position or alignment. The compressed air nozzle comes into a position and/or alignment in which the compressed air jet stream leaving the compressed air nozzle achieves the desired position for the cleaning of the thread cutting device 15 and/or for the cleaning of the capture mechanism 14 and/or further parts in the neighborhood of the thread cutting device 15.

To be sure, the compressed air jet will reach by ricochet diversions a great part of the capture mechanism 14, but nevertheless the cleaning efficiency in regard to this capture mechanism 14 can be substantially increased when the capture mechanism is being driven during this cleaning period. This is possible since for the already winding spool or following the insertion of an empty spool 16 in the spool apparatus 1 for this empty spool an auxiliary drive 8, placed on the presentation apparatus 7, is brought into driving contact with a drive roll 80 (FIG. 3). This drive roll 80 will drive the spool or the empty spool 16 and through this also drive the capture mechanism 14.

Since the cleaning apparatus 4 does not take part in this rotary motion, then the compressed air jet leaving the cleaning apparatus 4 as a result of the relative rotation strikes the entire circumferential area of the capture mechanism 14 and cleans it thereby.

In the case of an open-end spinning machine, the auxiliary drive 8 with the drive roll 80 is not limited to only fulfilling the purpose of running the capture mechanism for its cleaning, but can also beyond this serve as a drive for the spool or the empty spool 16 during a spin-start procedure.

Previously, embodiment examples were described in which the cleaning apparatus 4, which functions pneumatically, operates with compressed air and exhibits a compressed air nozzle 40 which is directed against the blade 150 of the thread cutting device 15 or the nozzle 40 can be presented thereto for that purpose. FIG. 4 now shows another design of a pneumatic cleaning apparatus which instead of using compressed air induces air flow with suction. Instead of a compressed air nozzle 40, now a suction nozzle is provided. This suction nozzle communicates by means of a suction line (not shown) and a control valve with a source of suction. This is all analogous to the pressurized system described in FIG. 1 in connection with the compressed air nozzle 40. The control of the flow of air induced by the suction is carried out likewise in an analogous manner by the controller 5.

A cleaning with the help of a suction procedure has the advantage that contaminating particulate which issues from the thread cutting device 15 as well as further particulate from the spool apparatus is removed. This air borne particulate cannot fly around uncontrolled but upon entering into the suction nozzle 45 the particulate comes into a closed air circulation system. Also, in the case of a suction operated cleaning apparatus 4 the suction induced air stream can be brought to intermittent operating action.

Obviously, it is also possible to equip the cleaning apparatus 4 both with a pressurized nozzle 40 as well as with a suction nozzle. Relative to the thread cutting device 15, the suction nozzle is installed opposite to the pressurized nozzle 40.

In this way the suction nozzle can pick up the loosened fiber and dirt particulate which is loosened from the thread cutting device 15 by the pressurized nozzle 40 and remove contaminating material possibly from other locations of the spool apparatus 1. This material is then removed and transported to disposal or recycling.

Alternatively, also another cleaning medium can find use, which for instance would be of a fluid consistence and/or bears small abrasive particulate and which medium is introduced through a feed nozzle against the thread cutting edge 151 for its cleaning and eventually also for the sharpening thereof. The spent medium is removed by means of an exit nozzle together with the loosened contaminant particles. In accord with the cleaning medium, in this way the sharpening can be coupled together with the cleaning operation of the thread cutting edge 151.

Even when in the foregoing exclusively pneumatic cleaning apparatuses have been described, this does not mean that other solutions to the problem are not possible as has been indicated above. FIG. 5 shows a mechanical cleaning apparatus 4 which will be described in the following.

The spool apparatus 1 and the thread cutting device 15 are illustrated as before. On the end of a presentation apparatus 70 proximal to the spool apparatus 1 which is independent of the shown presentation apparatus 7 of FIG. 2 and does not possess any auxiliary drive 8 for supplementary driving of the empty spool 16, is found a dirt catching apparatus 9 which is made in essentially the shape of a shell. Such a dirt catching apparatus 9 can possibly find use also in connection with a cleaning apparatus 4 possessing a compressed air nozzle 40 wherein by an appropriate design of its inner surface it could be prevented that contaminant which accumulates here can in a short period escape from the dirt catching apparatus 9. It is particularly necessary from time to time to empty this dirt catcher apparatus 9 so that the accumulating contaminant collections forming here do not become too large and thus the retention means in regard to collected dirt would no longer suffice.

In order to avoid this risk in accord with FIG. 5, a dirt removal or transport apparatus 90 is installed which can be principally constructed as a mechanical object. The dirt removal transport apparatus 90 in accord with FIG. 5 is formed in the interest of a simple illustration by a suction nozzle 92 connected to a suction line 91.

In accord with the embodiment shown in FIG. 5, the shell shaped dirt catcher apparatus 9 possesses a drive 46 for a mechanical cleaning element 47 of a cleaning apparatus 4. By appropriate placement of the cleaning element 47 on the presentation apparatus 70, for instance similar to the compressed air nozzle 40 shown in FIG. 3 the cleaning element 47 can be placed to serve the to-be-cleaned thread cutting edge 151 wherein principally the presentation apparatus 70 can execute a movement which is transmitted to the cleaning element 47 as a scraping motion. In accord with the embodiment shown in FIG. 5, the cleaning motion is produced by the drive 46 which for instance gives to the cleaning element 47 a back and forth movement which represents an intermittent control. The loosened dirt components fall below into the shell shaped dirt catching apparatus 9 from whence they are picked up by the suction induced air stream to the suction nozzle 92 add-on to the dirt collection or dirt capture apparatus from which place the contaminants are removed by the suction induced air stream. The drive 46 in this operation can be so designed that it will carry out no movements along a single movement axis, but these movements can be incorporated into second movements which extends transverse thereto for instance along the thread cutting edge 151.

The mechanical cleaning element 47 can be variously designed. Instead of a scraper as is shown in FIG. 5 which executes a straight line or complex movement, and which can be flexibly anchored or constructed, a rotating element can be provided. This rotating element can in this matter principally be driven in a rotary direction, preferably in the direction of the arrows $f_2$, that is, contrary to the feed direction of the thread (arrow $f_1$), or possibly even driven in alternating directions of rotation.

The mechanical cleaning element 47 can be variously designed. Instead of a scraper as is shown in FIG. 5 which executes a straight line or complex movement, and which can be flexibly anchored or constructed, a rotating element can be provided. This rotating element can in this matter principally be driven in a rotary direction, preferably in the direction of the arrows $f_2$, that is, contrary to the feed direction of the thread (arrow $f_1$) (see FIGS. 1 & 2), or possibly even driven in alternating directions of rotation.

It is also possible to provide a brush (not shown) for the cleaning apparatus 4 with which either axial or rotating or even both together complex cleaning motions can be carried out.

Independent of its special construction, the cleaning apparatus 4 and the dirt catching apparatus 9 are placed on a common presentation apparatus 7 or 70. In this way, the cleaning apparatus 4 and the dirt collection apparatus 9 can be located conveniently near to one another, especially by placement on an arm pivotably affixed to the presentation apparatus 7 or 70 (not shown) of one of these two apparatuses.

The foregoing description bases itself principally on the spool apparatus 1 of an open-end spinning machine. Obviously, in consideration of machine conditioned differences the cleaning apparatus 4 can find application in connection with other textile machines which exhibit a spool apparatus 1 and a thread cutting device 15 which is assigned thereto. It should be appreciated by those skilled in the art that various modifications and variations can be made in the present invention without departing from the spirit and scope of the invention.

What is claimed is:

1. A method for service at a workstation of a textile machine comprising the steps of:

presenting a thread to a spool apparatus;

capturing the thread by the spool apparatus;

conducting the thread to a thread cutting device operably disposed to an end of the spool apparatus, wherein the thread is cut by the thread cutting device; and cleaning the thread cutting device to remove unwanted material from the thread cutting device using a cleaning apparatus, wherein said cleaning step occurs independent of the actual thread cutting operations.

2. A method as set forth in claim 1, wherein the cleaning of the thread cutting device occurs before or after a thread is presented to the spool apparatus.

3. A method as set forth in claim 1, wherein the cleaning of the thread cutting device is done pneumatically in a direction generally opposite to a transport direction of the thread on the spool.

4. A method as set forth in claim 1, wherein the cleaning of the thread cutting device is executed in an intermittent manner.

5. A method as set forth in claim 1, wherein simultaneously with the cleaning of the thread cutting device, additional elements of the spool apparatus are subjected to cleaning.

6. A method as set forth in claim 5, wherein driveable elements of the spool apparatus to be cleaned are actively driven during their cleaning.

7. A method as set forth in claim 1, wherein the thread cutting device is sharpened during cleaning.

8. A method as set forth in claim 1, wherein the cleaning of the thread cutting device occurs during specified time intervals.

9. A method as set forth in claim 1, wherein the cleaning of the thread cutting device occurs in response to specified operations of the textile machine.

10. An apparatus for the servicing of a workplace on a textile machine comprising:

a spool apparatus into which a spool can be inserted and driven by a drive roll;

a driveable capture mechanism configured with the spool apparatus, rotation of the driveable capture mechanism eventually results in presenting thread to be cut;

a thread cutting device operably configured with the spool apparatus at an end thereto; and a cleaning apparatus disposed to the thread cutting device, said cleaning apparatus configured for cleaning the thread cutting device independent of the cutting operations of the thread cutting device.

11. An apparatus as set forth in claim 10, wherein the cleaning apparatus is moveable into an operational position relative with the thread cutting device.

12. An apparatus as set forth in claim 11, wherein the cleaning apparatus is located on a presentation apparatus which is placed on a mobile service carriage patrolling along a multiplicity of workstations of the textile machine, the cleaning apparatus is moveable between an at-rest position and an operational position adjacent the thread cutting device.

13. An apparatus as set forth in claim 12, wherein the presentation apparatus carries a driveable drive roll for the drive of an empty spool inserted into the spool apparatus.

14. An apparatus as set forth in claim 10, wherein the cleaning apparatus communicates with and is activated by a controller.

15. An apparatus as set forth in claim 10, wherein the cleaning apparatus is disposed such that a direction of cleaning action of the cleaning apparatus is opposite to the transport direction of a thread to the thread cutting device.

16. An apparatus as set forth in claim 10, wherein the cleaning apparatus is a pneumatic cleaning apparatus and includes a compressed air nozzle.

17. An apparatus as set forth in claim 10, wherein the cleaning apparatus is a mechanical apparatus that contacts a cutting edge of the thread cutting device as it cleans the thread cutting device.

18. An apparatus as set forth in claim 17, wherein the cleaning apparatus sharpens the thread cutting device as it contacts the cutting edge.

19. An apparatus as set forth in claim 10, wherein the cleaning apparatus has a flexible or flexibly secured guide coacting with the spool apparatus.

20. An apparatus as set forth in claim 10, wherein the cleaning apparatus has a dirt catcher.

21. An apparatus as set forth in claim 10, wherein the cleaning apparatus has a suction air nozzle.

22. An apparatus as set forth in claim 10, wherein the cleaning apparatus serves additional parts of the spool apparatus.

23. An apparatus as set forth in claim 22, wherein the parts of the spool apparatus to be cleaned by the cleaning apparatus are driven during their cleaning.

24. An apparatus as set forth in claim 10, wherein the cleaning apparatus possesses multiple directions of cleaning actions.

25. An apparatus as set forth in claim 24, wherein the cleaning apparatus includes both a suction mechanism and a compressed air nozzle.

* * * * *